US011295580B2

(12) United States Patent
Oyama et al.

(10) Patent No.: US 11,295,580 B2
(45) Date of Patent: Apr. 5, 2022

(54) INFORMATION PROCESSOR AND RECORDING MEDIUM

(71) Applicant: Universal Entertainment Corporation, Tokyo (JP)

(72) Inventors: Masaki Oyama, Tokyo (JP); Toshikazu Jinnouchi, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 188 days.

(21) Appl. No.: 16/660,941

(22) Filed: Oct. 23, 2019

(65) Prior Publication Data

US 2020/0143640 A1 May 7, 2020

(30) Foreign Application Priority Data

Nov. 2, 2018 (JP) ..... JP2018-207665

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01); *G07F 17/3244* (2013.01); *G07F 17/3262* (2013.01); *G07F 17/3267* (2013.01)

(58) Field of Classification Search
CPC ..... G07F 17/3267; G07F 17/3213; G07F 17/3244; G07F 17/34
See application file for complete search history.

(56) References Cited

U.S. PATENT DOCUMENTS 8,684,816 B2 * 4/2014 Ajiro ..... G07F 17/3202 463/20
2014/0087826 A1 * 3/2014 Caputo ..... G07F 17/34 463/20
2016/0093144 A1 * 3/2016 Kitamura ..... G07F 17/3267 463/20
2017/0200346 A1 * 7/2017 Fujisawa ..... G07F 17/3244
2019/0318585 A1 * 10/2019 Smith ..... G07F 17/3213

* cited by examiner

*Primary Examiner* — William H Mcculloch, Jr.
*Assistant Examiner* — Ankit B Doshi
(74) *Attorney, Agent, or Firm* — Potomac Law Group, PLLC; Kenneth Fagin

(57) ABSTRACT

Apparatuses such as an information processor, with which the winning probability of a specific payout at a predetermined timing is easily increased when there are many types of payouts. A server which executes a slot game in which a payout is awarded based on a randomly determined symbol combination includes a controller which is programmed to execute the processes of: a) accepting the use of a GIGA WIN confirmation item with which the probability of rearrangement of a symbol combination corresponding to a payout of "GIGA WIN" among plural symbol combinations is increased; and b) when the GIGA WIN confirmation item is used, displaying the symbol combination corresponding to the payout of "GIGA WIN" and awarding the payout.

8 Claims, 14 Drawing Sheets

FIG.5

SYMBOL ARRAYS OF VIDEO REELS

| | REEL 1 | REEL 2 | REEL 3 | REEL 4 | REEL 5 |
|---|---|---|---|---|---|
| 0 | HEART | 9 | CHERRY | 9 | KING |
| 1 | CHERRY | JACK | KING | JACK | ACE |
| 2 | 7 | HEART | 9 | WILD | BELL |
| 3 | JACK | 7 | ACE | 9 | KING |
| 4 | KING | 10 | BELL | JACK | BONUS |
| 5 | WATERMELON | 9 | JACK | HEART | WATERMELON |
| 6 | 10 | ACE | WATERMELON | KING | QUEEN |
| 7 | BELL | BELL | 10 | JACK | HEART |
| 8 | JACK | JACK | CHERRY | 10 | JACK |
| 9 | 9 | WATERMELON | 10 | BELL | 9 |
| 10 | ACE | 9 | WATERMELON | 9 | CHERRY |
| 11 | JACK | CHERRY | 10 | ACE | 10 |
| 12 | ACE | ACE | KING | BONUS | 7 |
| 13 | BELL | QUEEN | HEART | 9 | ACE |
| 14 | KING | 9 | 7 | QUEEN | JACK |
| 15 | QUEEN | KING | 10 | 7 | 9 |
| 16 | HEART | WILD | 7 | CHERRY | KING |
| 17 | JACK | ACE | QUEEN | HEART | JACK |
| 18 | 10 | QUEEN | 10 | ACE | ACE |
| 19 | BONUS | WATERMELON | WILD | KING | BELL |
| 20 | 9 | 10 | QUEEN | WATERMELON | QUEEN |
| 21 | CHERRY | 9 | 10 | 10 | ACE |
| 22 | JACK | QUEEN | CHERRY | BELL | 9 |
| 23 | 10 | CHERRY | ACE | 9 | WATERMELON |
| 24 | WATERMELON | ACE | BONUS | 10 | 10 |
| 25 | JACK | BONUS | QUEEN | CHERRY | ACE |
| 26 | | 7 | BELL | KING | CHERRY |
| 27 | | 10 | 9 | | QUEEN |
| 28 | | BELL | | | ACE |
| 29 | | | | | HEART |
| 30 | | | | | 10 |
| 31 | | | | | BELL |
| 32 | | | | | ACE |
| 33 | | | | | KING |
| 34 | | | | | |

FIG.6

(GIGA WIN CONFIRMATION SYMBOL COMBINATION TABLE)

⋮

A10

| | REEL 1 | REEL 2 | REEL 3 | REEL 4 | REEL 5 |
|---|---|---|---|---|---|
| UPPER STAGE | JACK | BELL | BELL | ACE | HEART |
| UPPER MIDDLE STAGE | 10 | JACK | JACK | KING | 10 |
| LOWER MIDDLE STAGE | WATERMELON | WATERMELON | WATERMELON | WATERMELON | BELL |
| LOWER STAGE | JACK | 9 | 10 | 10 | ACE |

⋮

A20

| | REEL 1 | REEL 2 | REEL 3 | REEL 4 | REEL 5 |
|---|---|---|---|---|---|
| UPPER STAGE | ACE | ACE | ACE | ACE | QUEEN |
| UPPER MIDDLE STAGE | BELL | BELL | BELL | BONUS | HEART |
| LOWER MIDDLE STAGE | KING | JACK | JACK | 9 | JACK |
| LOWER STAGE | QUEEN | WATERMELON | WATERMELON | QUEEN | 9 |

⋮

A80

| | REEL 1 | REEL 2 | REEL 3 | REEL 4 | REEL 5 |
|---|---|---|---|---|---|
| UPPER STAGE | HEART | JACK | KING | ACE | KING |
| UPPER MIDDLE STAGE | CHERRY | HEART | HEART | BONUS | JACK |
| LOWER MIDDLE STAGE | 7 | 7 | 7 | 9 | ACE |
| LOWER STAGE | JACK | 10 | 10 | QUEEN | BELL |

⋮

FIG.7

(GOD WIN CONFIRMATION SYMBOL COMBINATION TABLE)

⋮

B10

| | REEL 1 | REEL 2 | REEL 3 | REEL 4 | REEL 5 |
|---|---|---|---|---|---|
| UPPER STAGE | ACE | ACE | ACE | 10 | QUEEN |
| UPPER MIDDLE STAGE | BELL | BELL | BELL | BELL | HEART |
| LOWER MIDDLE STAGE | KING | JACK | JACK | 9 | JACK |
| LOWER STAGE | QUEEN | WATERMELON | WATERMELON | ACE | 9 |

⋮

B50

| | REEL 1 | REEL 2 | REEL 3 | REEL 4 | REEL 5 |
|---|---|---|---|---|---|
| UPPER STAGE | JACK | BELL | BELL | ACE | ACE |
| UPPER MIDDLE STAGE | 10 | JACK | JACK | KING | 9 |
| LOWER MIDDLE STAGE | WATERMELON | WATERMELON | WATERMELON | WATERMELON | WATERMELON |
| LOWER STAGE | JACK | 9 | 10 | 10 | 10 |

⋮

B60

| | REEL 1 | REEL 2 | REEL 3 | REEL 4 | REEL 5 |
|---|---|---|---|---|---|
| UPPER STAGE | HEART | JACK | KING | 9 | KING |
| UPPER MIDDLE STAGE | CHERRY | HEART | HEART | QUEEN | JACK |
| LOWER MIDDLE STAGE | 7 | 7 | 7 | 7 | ACE |
| LOWER STAGE | JACK | 10 | 10 | CHERRY | BELL |

⋮

FIG.8

SYMBOL COMBINATION TABLE

| SYMBOL | GRAPHICS | 1 | 2 | 3 | 4 | 5 |
|---|---|---|---|---|---|---|
| WILD | | 0 | 0 | 0 | 0 | 0 |
| 7 | | 0 | 0 | 50 | 300 | 1000 |
| HEART | | 0 | 0 | 35 | 200 | 800 |
| BELL | | 0 | 0 | 30 | 100 | 500 |
| WATERMELON | | 0 | 0 | 20 | 50 | 300 |
| CHERRY | | 0 | 0 | 15 | 35 | 300 |
| ACE | A | 0 | 0 | 10 | 30 | 200 |
| KING | K | 0 | 0 | 10 | 20 | 200 |
| QUEEN | Q | 0 | 0 | 10 | 15 | 100 |
| JACK | J | 0 | 0 | 10 | 15 | 100 |
| TEN | 10 | 0 | 0 | 5 | 15 | 100 |
| NINE | 9 | 0 | 0 | 5 | 10 | 100 |

| SYMBOL | GRAPHICS | 1 | 2 | 3 | 4 | 5 |
|---|---|---|---|---|---|---|
| BONUS | | 0 | 0 | 5FG | 10FG | 20FG |

※BONUS SYMBOL IS SCATTER SYMBOL

INFORMATION PROCESSOR AND RECORDING MEDIUM

CROSS-REFERENCE TO RELATED APPLICATION

This application claims the benefit of Japanese Patent Application No. 2018-207665 filed on Nov. 2, 2018, which application is incorporated herein by reference in its entirety.

FIELD OF THE INVENTION

The present invention relates to an information processor and a recording medium.

BACKGROUND OF THE INVENTION

Social games have recently been provided. In such a social game, a game provided from a server (information processor) is played on terminal devices such as smartphones owned by many players, over a communication network.

In the social games, there is a slot game in which symbols to be rearranged are randomly determined (symbol random determination), the arrangement pattern of the symbols selected by the random determination is displayed on a display, and a payout is awarded in accordance with the displayed arrangement pattern of the symbols (see Patent Literature 1 (U.S. Pat. No. 8,684,816)).

In the slot game, furthermore, an effect advantageous for a player may be exerted when a predetermined item which has been purchased or awarded in the progress of the game is used. For example, when a predetermined item is used, the probability of display of an arrangement pattern of symbols corresponding to a predetermined payout is increased in a predetermined period.

BRIEF SUMMARY OF THE INVENTION

There are many types of payouts awarded in accordance with arrangement patterns of symbols, and these payouts include a special payout with which a payout amount is relatively large in comparison with the bet amount. When, among many types of payouts, only the winning probability of an arrangement pattern corresponding to a special payout is increased at a predetermined timing, it is necessary to take measures such as decrease of the winning probabilities of arrangement patterns corresponding to payouts which are not related to the special payout, and the construction of a program for controlling such a routine may be complicated.

An object of the present invention is to provide apparatuses such as an information processor, with which the probability of awarding a specific payout at a predetermined timing is easily increased, when there are many types of payouts.

The present invention relates to an information processor which is capable of executing a game in which symbol random determination is performed to select symbols to be rearranged and a payout is awarded when an arrangement pattern of the selected symbols corresponds to one of arrangement patterns prepared in advance, the information processor comprising a controller programmed to execute the processes of: a) accepting an input for rearranging symbols in an arrangement pattern corresponding to a specific payout among payouts; and b) when the input is accepted in the process a), rearranging the symbols in the arrangement pattern corresponding to the specific payout and awarding the specific payout, no matter whether the symbol random determination is performed or not.

According to the arrangement above, when an input for awarding a specific payout is accepted in a process of repeated execution of the game, an arrangement pattern corresponding to the specific payout is rearranged no matter whether symbol random determination of determining an arrangement pattern of symbols is executed or not. With this arrangement, a state of awarding a specific payout is intentionally created by an input made by the player oneself, while there are plural arrangement patterns, and hence the probability of awarding a predetermined payout is easily increased.

According to the present invention, the above-described information processor is arranged such that the controller is configured to further execute the processes of:

in the process b), when the input is accepted in the process a), randomly determining at which timing the symbols are rearranged in the arrangement pattern corresponding to the specific payout, during a period in which the probability of rearrangement of the symbols in the arrangement pattern corresponding to the specific payout is increased; and when the game is executed at the determined timing, rearranging the symbols in the arrangement pattern corresponding to the specific payout and awarding the specific payout, no matter whether the symbol random determination is performed or not.

According to the arrangement above, in the process of repeated execution of the game, when it is aimed to increase only the probability of rearrangement of the arrangement pattern corresponding to the specific payout during a period in which the probability of rearrangement of the specific payout is desired to be increased, at which timing the arrangement pattern corresponding to the specific payout is rearranged is randomly determined. When the game is executed at the determined timing, the arrangement pattern corresponding to the specific payout is rearranged. This makes it possible to easily increase the probability of awarding the specific payout during the predetermined period by an input made by the player oneself, while there are plural arrangement patterns.

According to the present invention, the above-described information processor is arranged such that, at start of the game, the controller executes a process of accepting betting, and the arrangement pattern of the symbols rearranged in the process b) is randomly selected from plural arrangement patterns, and the plural arrangement patterns are associated with the specific payout which is predetermined times as much as an accepted bet amount.

Because one arrangement pattern is randomly selected from plural arrangement patterns, it is possible to set plural payouts corresponding to the specific payout. This makes it possible to easily increase the winning probability of plural specific payouts during the predetermined period. The plural specific payouts are associated with payouts each of which is predetermined times as much as a received bet amount. This makes it possible to easily increase the winning probability of a specific payout which is predetermined times as much as a received bet amount.

The present invention relates to a non-volatile recording medium storing a game program executed by an information processor which is capable of executing a game in which symbol random determination is performed to select symbols to be rearranged and a payout is awarded when an arrangement pattern of the selected symbols corresponds to one of arrangement patterns prepared in advance, the game program causing the information processor to execute the processes of:

a) accepting an input for rearranging the symbols in an arrangement pattern corresponding to a specific payout among payouts; and b) when the input is accepted in the process a), rearranging the symbols in the arrangement pattern corresponding to the specific payout and awarding the specific payout, no matter whether the symbol random determination is performed or not.

It is possible to provide an information processor and a program, with which the winning probability of a specific payout at a predetermined timing is easily increased when there are many types of payouts.

BRIEF DESCRIPTION OF THE DRAWINGS

FIG. 5 illustrates a symbol arrangement on video reels in the slot game.

FIG. 6 illustrates a GIGA WIN confirmation symbol combination table.

FIG. 7 illustrates a GOD WIN confirmation symbol combination table.

FIG. 8 illustrates a symbol combination table of the slot game.

DETAILED DESCRIPTION OF THE PREFERRED EMBODIMENT

Embodiment

An information processor of the present embodiment will be described with reference to figures.

Figure 1:
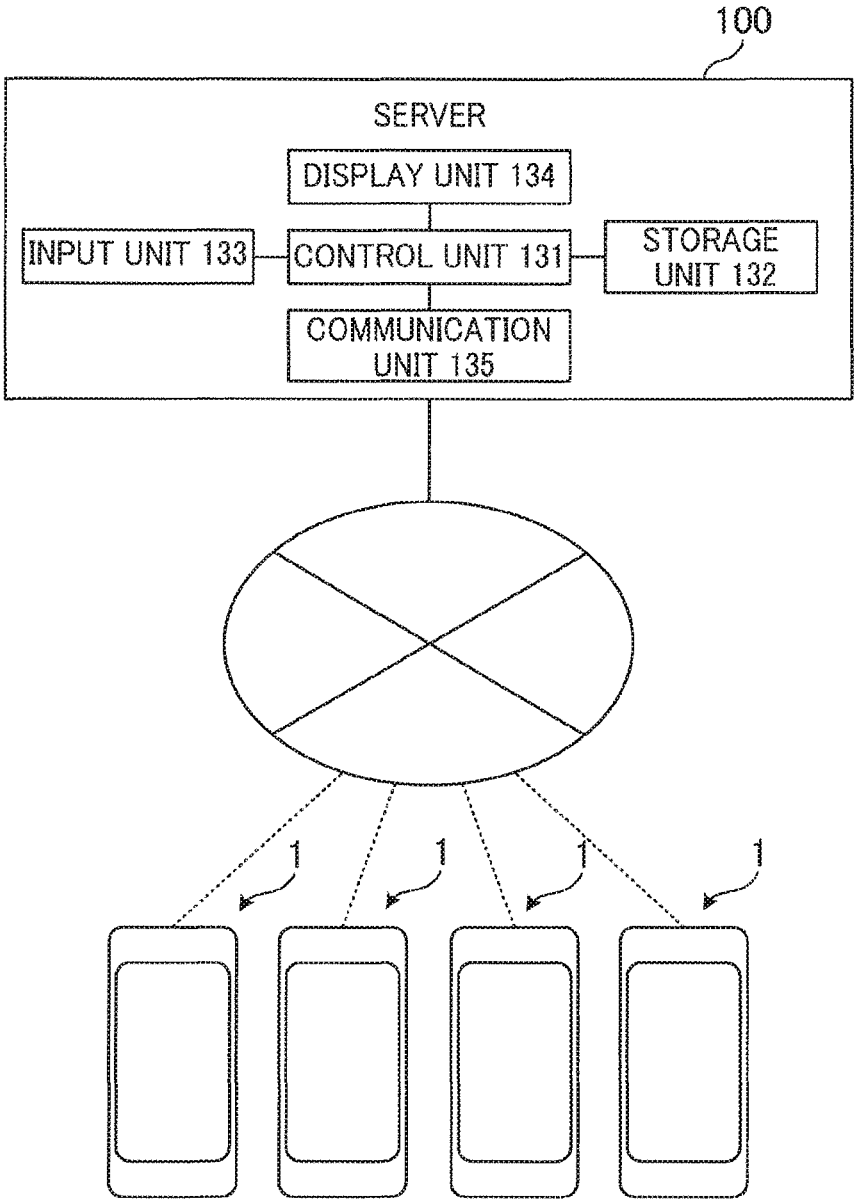
FIG. 1 illustrates a network environment between a server and a smartphone.

As shown in FIG. 1, a slot game (unit game) of the present embodiment is embodied as a social game which is executed through exchange of game data between a server 100 (information processor) and each smartphone 1, etc. over the Internet (communication line). To be more specific, game software of the slot game is run on a web browser provided by the server 100. As a result of player's access to the web browser provided by the server 100 through a terminal device such as a smartphone 1 and a PC, the slot game is run.

Figure 2:
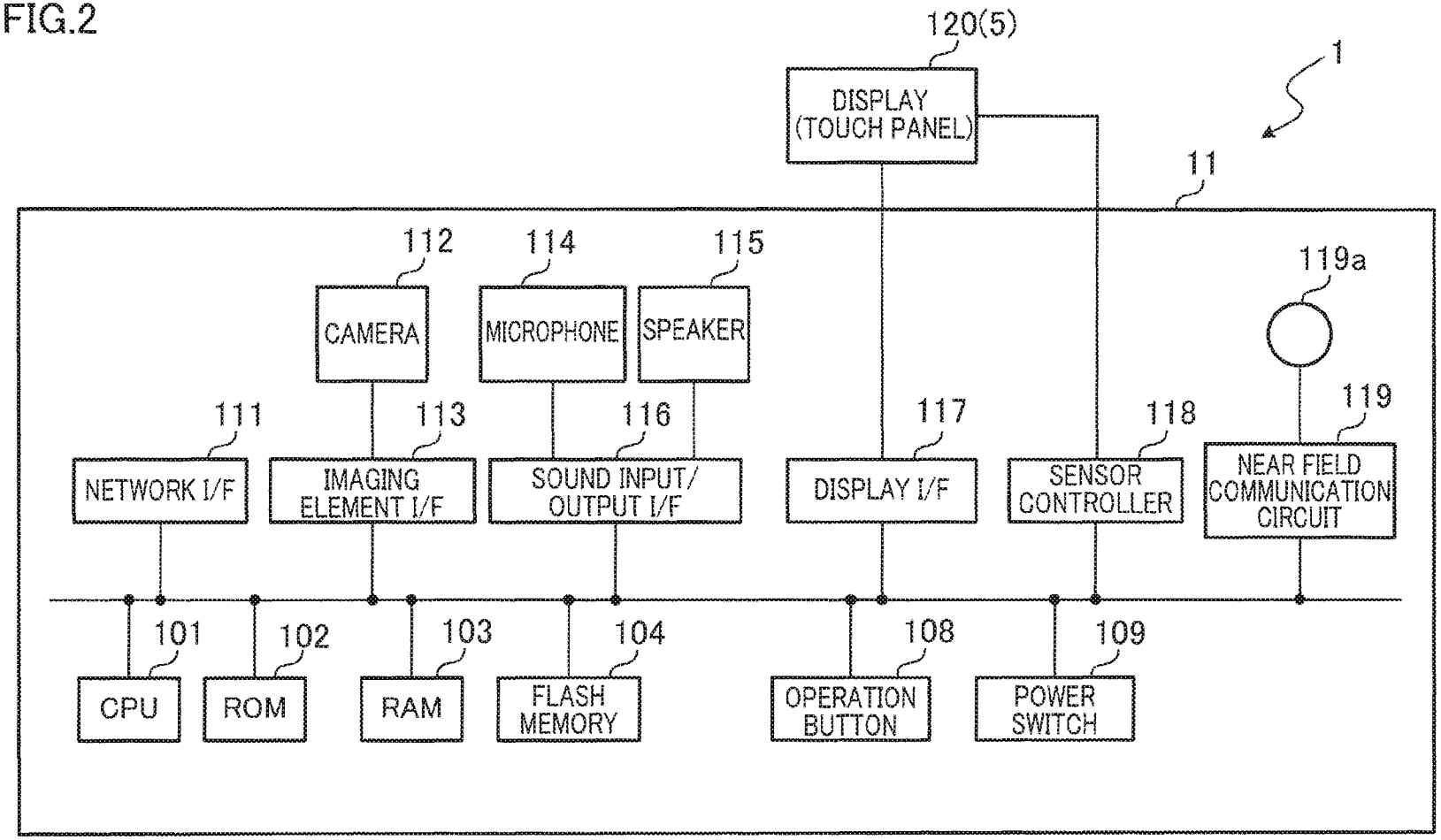
FIG. 2 is a block diagram of the electrical configuration of the smartphone.

In the present embodiment, the server 100 shown in FIG. 1 is taken as an example of the information processor, and the smartphone 1 shown in FIG. 2 is taken as an example of the terminal device. In the present embodiment, part of or all of the processes executed by the server 100 may be executed by the smartphone 1. In such a case, a combination of the server 100 and the smartphone 1 is regarded as an information processor which is integrally controlled. The processes and actions of the server 100 and the smartphone 1 can be interpreted as those of a program, a game control method, or a system realized between the server 100 and the smartphone 1.

(Online)

The slot game of the present embodiment is run as an online game. To be more specific, as shown in FIG. 1, the server 100 managed by an administration organization of the slot game is connected to smartphones 1 of many players over the Internet.

In this way, the slot game is run online. As a result of player's access to the web browser provided by the server 100 through an information device such as a smartphone 1 and a PC, the slot game can be run. The server 100 is configured to exchange credits (which can be bought by cash, a credit card, electronic money, a prepaid card, etc.) owned by players to coins (gaming media) which are electronic information usable in the slot game, and to manage the coins owned by the players.

(Structure of Server 100)

As shown in FIG. 1, the server 100 is an information processor which is used by an administrator of the slot game, etc. to manage and control a social game service. As the server 100 receives a request or game data from a smartphone 1 operated by a player, the server 100 sends a game program, a web browser, game data, etc. which can be run on the smartphone 1. The server 100 of the present embodiment includes a control unit 131, a storage unit 132, an input unit 133, a display unit 134, and a communication unit 135.

The control unit 131 (e.g., a CPU, equivalent to a controller) is configured to control the server 100. Furthermore, data is sent and received between the control unit 131, the storage unit 132, the input unit 133, the display unit 134, and the communication unit 135.

The storage unit 132 is constituted by a ROM (Read Only Memory) storing a system program, a RAM (Random Access Memory) which is a rewritable storage area, a flash memory, etc.

The input unit 133 is a device allowing the administrator or the like to input setting or the like of the slot game, and is embodied by a keyboard and a mouse, for example.

The display unit 134 is configured to display an operation screen for the administrator, in response to an instruction from the control unit 131.

The communication unit 135 is provided to communicate with the smartphones 1.

(Structure of Smartphone 1)

As shown in FIG. 2, the smartphone 1 includes, in the housing 11, a CPU 101, a ROM 102, a RAM 103, a flash memory 104, an operation button 108, a power switch 109, a bus line 110, a network I/F 111, a camera 112, an imaging element I/F 113, a microphone 114, a speaker 115, a sound input/output I/F 116, a display I/F 117, a sensor controller 118, a near field communication circuit 119, and an antenna 119*a* of the near field communication circuit 119. In the front surface of the housing 11, a display 120 with a touch panel 5 (input unit) is embedded.

The display 120 is configured to be able to display images. The display method of the display 120 is, for example, liquid crystal, organic electroluminescence, CRT (Cathode Ray Tube), or plasma.

The CPU (Central Processing Unit) 101 controls the entire smartphone 1. The ROM (Read Only Memory) 102 stores programs used for driving the CPU 101, such as an IPL (Initial Program Loader).

The RAM (Random Access Memory) 103 is used as a work area of the CPU 101. The flash memory 104 stores application software (program) for running the game of the present embodiment, a communication program, and data such as image data and sound data. The operation button 108 is used for, for example, initial setting of the smartphone 1. The power switch 109 is used for turning on/off the power source of the smartphone 1.

The network I/F (Interface) 111 is an interface for performing data communication with the server 100, etc., by utilizing a communication network such as the Internet. The camera 112 is a built-in camera image capturing means which captures an image of an object to obtain image data under the control of the CPU 101. The imaging element I/F 113 is a circuit for controlling the camera 112. The microphone 114 is a built-in sound collection means to which sound is input. The sound input/output I/F 116 is a circuit for processing input and output of a sound signal between the microphone 114 and the speaker 115 under the control of the CPU 101. The display I/F 117 is a circuit for sending image data to the display 120 under the control of the CPU 101. The sensor controller 118 is a circuit for receiving an input from the touch panel 5 of the display 120. The near field communication circuit 119 is a communication circuit based on NFC (Near Field Communication) (Registered Trademark). Bluetooth (Registered Trademark), or the like. The bus line 110 is an address bus, a data bus, or the like for electrically connecting the components such as the CPU 101.

(Outline of Slot Game Executed by Server 100)

Figure 3:
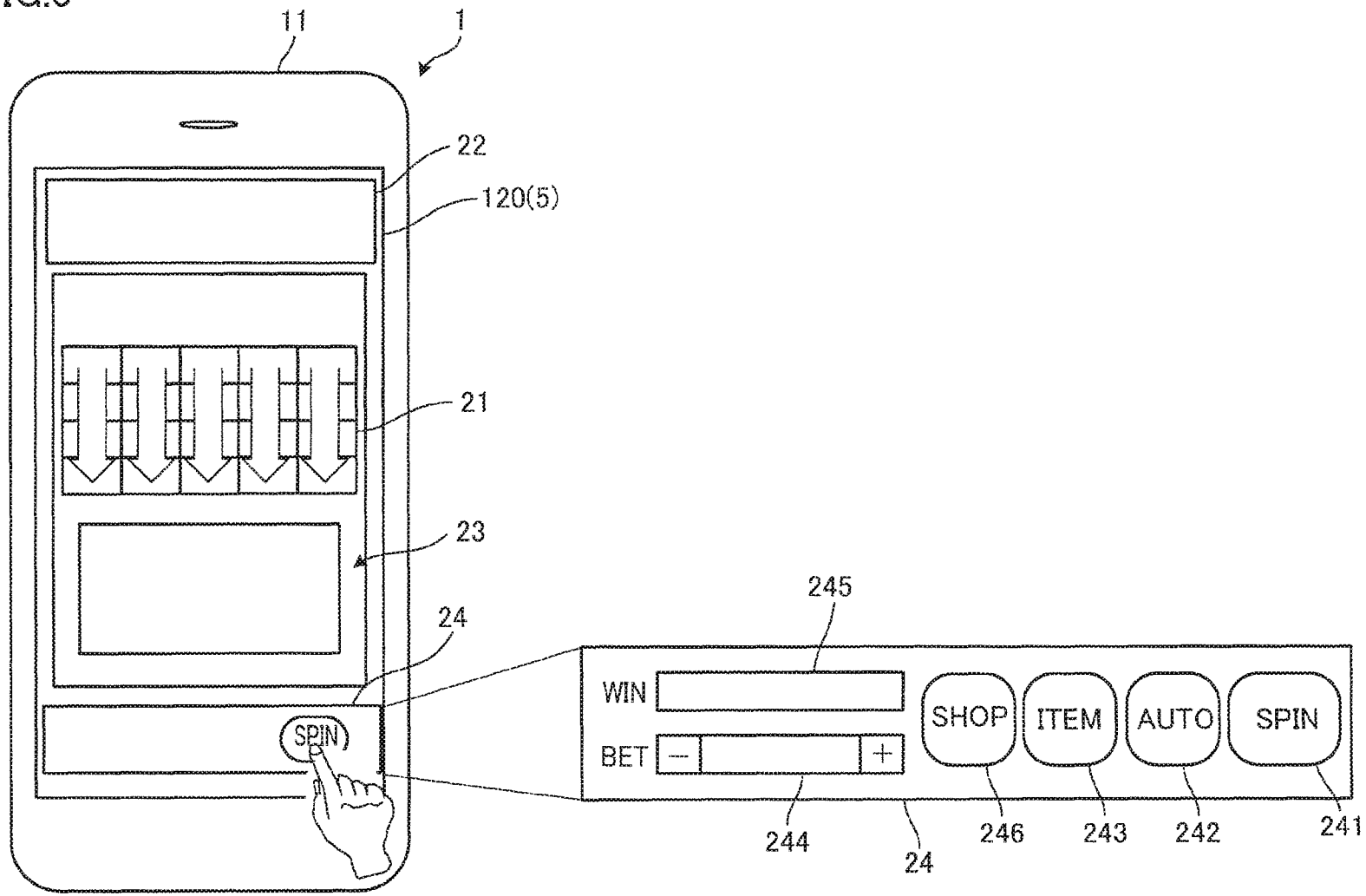
FIG. 3 shows a display state of a slot game on the smartphone.

When a request is sent from the smartphone 1 to the server 100, effect images, videos, etc. of the slot game are displayed by a web browser on the display 120 of the smartphone 1. Thereafter, the slot game starts upon selection of a selection image indicating the start of the slot game on the touch panel 5. For example, as shown in FIG. 3, when the slot game starts, the slot game in which symbols are rearranged in a symbol display area 21 which is formed of 20 areas forming a matrix with 5 columns and 4 rows becomes executable.

Plural types of slot games may be executable, and the rule, the state of payout, and effect images may be different depending on which slot game is executed. For example, in a slot game of one type, symbols are rearranged in a symbol display area formed of 9 areas forming a matrix with 3 columns and 3 rows. In this slot game, whether a win is achieved is determined based on a combination of symbols rearranged on a payline set only at the middle stage of the symbol display area (winning determination).

The slot game of the present embodiment is basically started in response to the consumption of a predetermined amount of coins (gaming media) owned by a player. When a predetermined condition is satisfied, the player is able to start the slot game without the consumption of coins. (The predetermined condition is, for example, a condition of awarding a free game or the slot game is playable without the consumption of coins for a predetermined number of times in a day.)

The coins owned by players are electronic information. A player accesses the server 100 via the smartphone 1 and exchanges credits to coins in accordance with a payment method specified by the management organization of the slot game. The coins owned by players are used in various ways. For example, the coins are consumed to obtain an effect influencing on the slot game (as purchase of items), or consumed to change the appearance of an avatar of a player.

The number of coins owned by each player, which is managed by the server 100, is shared between the server 100 and each smartphone 1.

The gaming medium is not limited to any particular type, and may be electronic money or a game point not including valuable information.

Slot Game: Definitions

The slot game executed in the present embodiment is, as shown in FIG. 3, a game in which symbols are varied in the symbol display area 21 (scrolling image of reels) and then stopped (rearranged), and a benefit (e.g., a payout or an item advantageous for the player) is awarded based on the combination of the symbols (arrangement pattern of the symbols) displayed in the symbol display area 21. A state in which symbols are displayed after being varied and stopped in the symbol display area 21 is termed "rearrangement".

A payout awarded based on a combination of symbols displayed in the symbol display area 21 is awarding of coins.

The "unit game" is a series of operations from the start of the receiving of a bet to the establishment of a prize (i.e., a combination of symbols satisfies a predetermined relation). To put it differently, the unit game includes a single bet time for receiving a bet, a single game time of rearranging symbols, and a single payout time of a payout process of awarding a payout.

(Slot Game Screen)

A slot game screen displayed on the display 120 of the smartphone 1 will be described.

As shown in FIG. 3, when the slot game is executed, the slot game screen is displayed on the display 120. The slot game screen displays the symbol display area 21 formed of 20 areas forming a matrix with 5 columns and 4 rows, a game information display area 22 on which information of increment and decrement in accordance with the execution of the slot game (e.g., the number of currently-owned coins) is displayed, an effect display area 23 on which moving and still images and messages related to the game are displayed in accordance with the progress of the slot game, and an operation display area 24 which is operated by the player to progress the slot game. The operation display area 24 includes a spin button 241, an AUTO button 242, an ITEM button 243, a bet button 244, a WIN display portion 245, and a shop button 246.

On the entire surface of the display 120, a touch panel 5 which allows the slot game screen to be viewable from the outside is provided. The touch panel 5 makes it possible to detect the coordinates of a part touched by a player's finger or the like. With this arrangement, for example, the slot game (unit game) is executed once, upon a touch input of the image of the spin button 241. Furthermore, the slot game is serially executed plural times as the image of the AUTO button 242 is pressed. When the image of the ITEM button 243 is pressed, the player is able to select and use a previously-obtained item (which exerts an influence in the slot game). When the image of the shop button 246 is touched, the smartphone 1 accesses the server 100 and the player enters a shop in which credits (which can be bought by cash, a credit card, electronic money, a prepaid card, etc. owned by the player) are exchangeable with coins, or credits or coins are exchangeable with an item.

(Paylines)

In the symbol display area 21, five video reels on which symbols are provided (see FIG. 5) are scrolled, and are rearranged after a predetermined time elapses. As a result, parts of each video reel (four successive symbols in the present embodiment) are displayed for the player. In the symbol display area 21, one symbol is displayed in each of the four areas in the upper stage, the upper middle stage, the lower middle stage, and the lower stage, in each video reel. To put it differently, 20 symbols forming a matrix with 5 columns and 4 rows are displayed in the symbol display area 21 (see FIG. 13).

Figure 4:
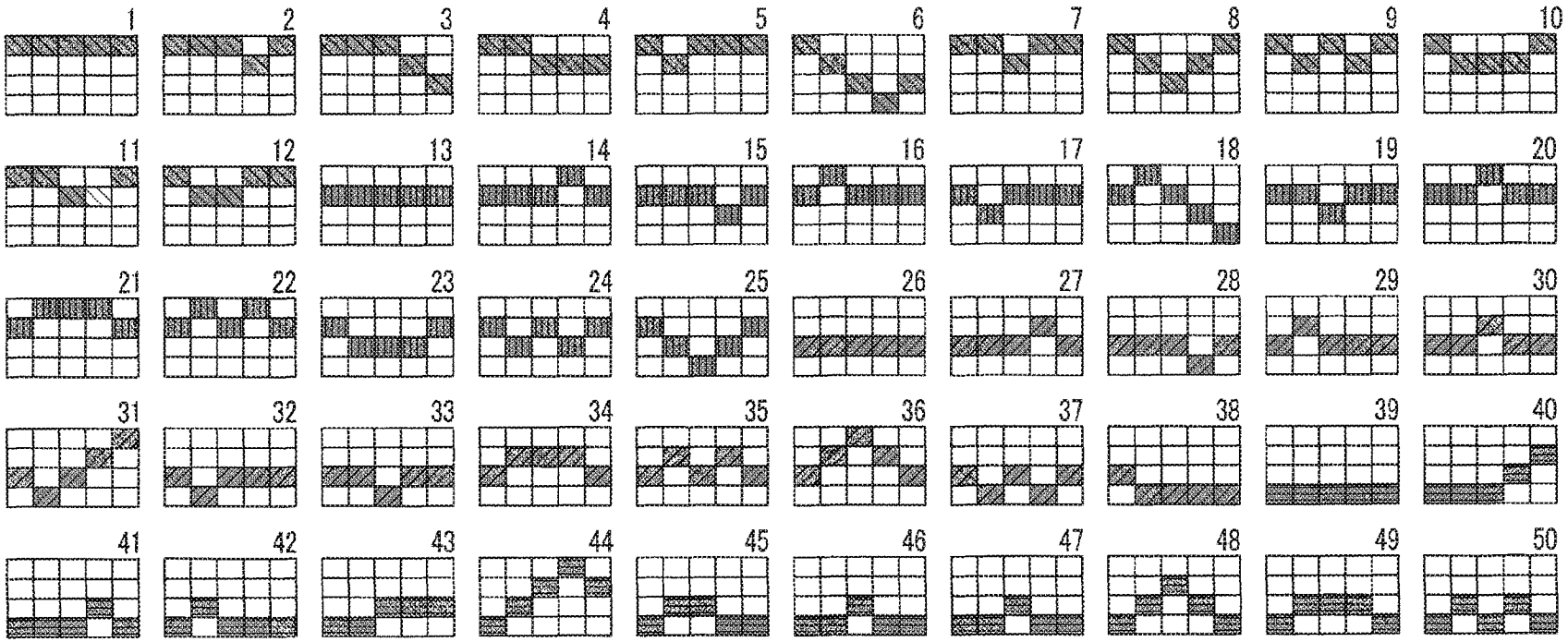
FIG. 4 shows paylines of the slot game.

In the present embodiment, one of four stages, i.e., the upper stage, the upper middle stage, the lower middle stage, and the lower stage, is selected in each of the video reels, and a line connecting the selected stages is used as a payline (see FIG. 4). When three or more symbols of the same type are successively rearranged on the payline, a win is achieved (a payout is awarded) (see FIG. 6). In regard to the number of the paylines, while there are 50 paylines in the present embodiment as shown in FIG. 5, the number of the paylines may be 30, for example.

(Symbol Arrays of Video Reels)

Now, with reference to FIG. 5, the following describes a configuration of the symbol arrays on the video reels of the slot game.

As shown in FIG. 5, to each of "REEL1", "REEL2", "REEL3", "REEL4", and "REEL5" of the video reels 3, a symbol array formed of symbols corresponding to code numbers 0 to 33 is allocated. The types of the symbols arranged on the symbol arrays of the video reels include normal symbols such as "7", "HEART", "BELL", "WATERMELON", "CHERRY", "ACE", "KING", "QUEEN", "JACK", "10", and "9", a "BONUS" symbol with which BONUS triggering the awarding of a free game is won, and a "WILD" symbol which is an almighty symbol that can substitute for any other symbol. The "BONUS" symbol is a scatter symbol, and a win is achieved based on the number of "BONUS" symbols rearranged in the symbol display area 21, irrespective of payline.

(GIGA WIN Confirmation Symbol Combination Table) A GIGA WIN confirmation symbol combination table shown in FIG. 6 is a random determination table which is referred to in a later-described symbol arrangement pattern random determination process (see FIG. 10). This random determination table is used for confirming that a payout which is 60 to 99 times as much as a bet amount, i.e., an amount of coins betted at the start of a slot game (unit game), is awarded, when a GIGA WIN confirmation item is used in the slot game. In the GIGA WIN confirmation symbol combination table of the present embodiment, as shown in FIG. 6, 100 symbol combinations A1 to A100 which are to be displayed in the symbol display area 21 are set. Each of payouts corresponding to these 100 symbol combinations A1 to A100 is all 60 to 99 times as much as an amount of betted coins.

For example, in the case of the symbol combination A10 shown in FIG. 6, 3Kinds of "JACK" is established on a payline 10 (see FIG. 4) and 4Kinds of "WATERMELON" is established on a payline 26 (see FIG. 4). In this case, the payout is "10"+"50"="60" (see FIG. 8), i.e., the payout is 60 times as much as the amount of betted coins. In the case of the symbol combination A20 shown in FIG. 6, 4Kinds of "ACE" is established on a payline 1 (see FIG. 4) and 3Kinds of "BELL" is established on a payline 13 (see FIG. 4). In this case, the payout is "30"+"30"="60" (see FIG. 8), i.e., the payout is 60 times as much as the amount of betted coins. In the case of the symbol combination A80 shown in FIG. 6, 3Kinds of "HEART" is established on the payline 10 (see FIG. 4) and 3Kinds of "7" is established on the payline 26 (see FIG. 4). In this case, the payout is "35"+"50"="85" (see FIG. 8), i.e., the payout is 85 times as much as the amount of betted coins. The probabilities of random selection of the 100 symbol combinations A1 to A100 set in the GIGA WIN confirmation symbol combination table of the present embodiment are equally 1/100. Alternatively, the random determination probabilities may be different between the symbol combinations.

(GOD WIN Confirmation Symbol Combination Table)

A GOD WIN confirmation symbol combination table shown in FIG. 7 is a random determination table which is referred to in a later-described symbol arrangement pattern random determination process (see FIG. 10). This random determination table is used for confirming that a payout which is 100 or more times as much as a bet amount, i.e., an amount of coins betted at the start of a slot game (unit game), is awarded when a GOD WIN confirmation item is used in the slot game. In the GOD WIN confirmation symbol combination table of the present embodiment, as shown in FIG. 7, 100 symbol combinations B1 to B100 which are to be displayed in the symbol display area 21 are set. Each of payouts corresponding to these 100 symbol combinations A1 to A100 is all 100 or more times as much as an amount of betted coins.

For example, in the case of the symbol combination B10 shown in FIG. 7, 3Kinds of "ACD" is established on the payline 1 (see FIG. 4) and 4Kinds of "BELL" is established on the payline 13 (see FIG. 4). In this case, the payout is "10"+"100"="110" (see FIG. 8), i.e., the payout is 110 times as much as the amount of betted coins. In the case of the symbol combination B50 shown in FIG. 7, 3Kinds of "JACK" is established on the payline 10 (see FIG. 4) and 5Kinds of "WATERMELON" is established on the payline 26 (see FIG. 4). In this case, the payout is "10"+"300"="310" (see FIG. 8), i.e., the payout is 310 times as much as the amount of betted coins. In the case of the symbol combination B60 shown in FIG. 7, 3Kinds of "HEART" is established on the payline 10 (see FIG. 4) and 4Kinds of "7" is established on the payline 26 (see FIG. 4). In this case, the payout is "35"+"300"="335" (see FIG. 8), i.e., the payout is 335 times as much as the amount of betted coins. The probabilities of random selection of the 100 symbol combinations B1 to B100 set in the GOD WIN confirmation symbol combination table of the present embodiment are equally 1/100. Alternatively, the random determination probabilities may be different between the symbol combinations.

(Symbol Combination Table)

Now, a symbol combination table will be described with reference to FIG. 8. FIG. 8 shows a symbol combination table used in the slot game of the present embodiment.

The symbol combination table of the slot game defines the combinations of symbols (arrangement patterns of symbols) with which a win is achieved and defines payout amounts of coins paid out (payout). In the slot game, scroll of five video reels is stopped, and a win is achieved when three or more symbols of the same type are successively rearranged on a payline which is a target of result determination, in the symbol display area 21 (see FIG. 8). In accordance with the type of win, a benefit will be given to the player in the form of awarding a payout and the like. A payout amount defined in the symbol combination table shown in FIG. 8 is a payout amount when the number of betted coins is 1.

[Contents of Program]

Figure 9:
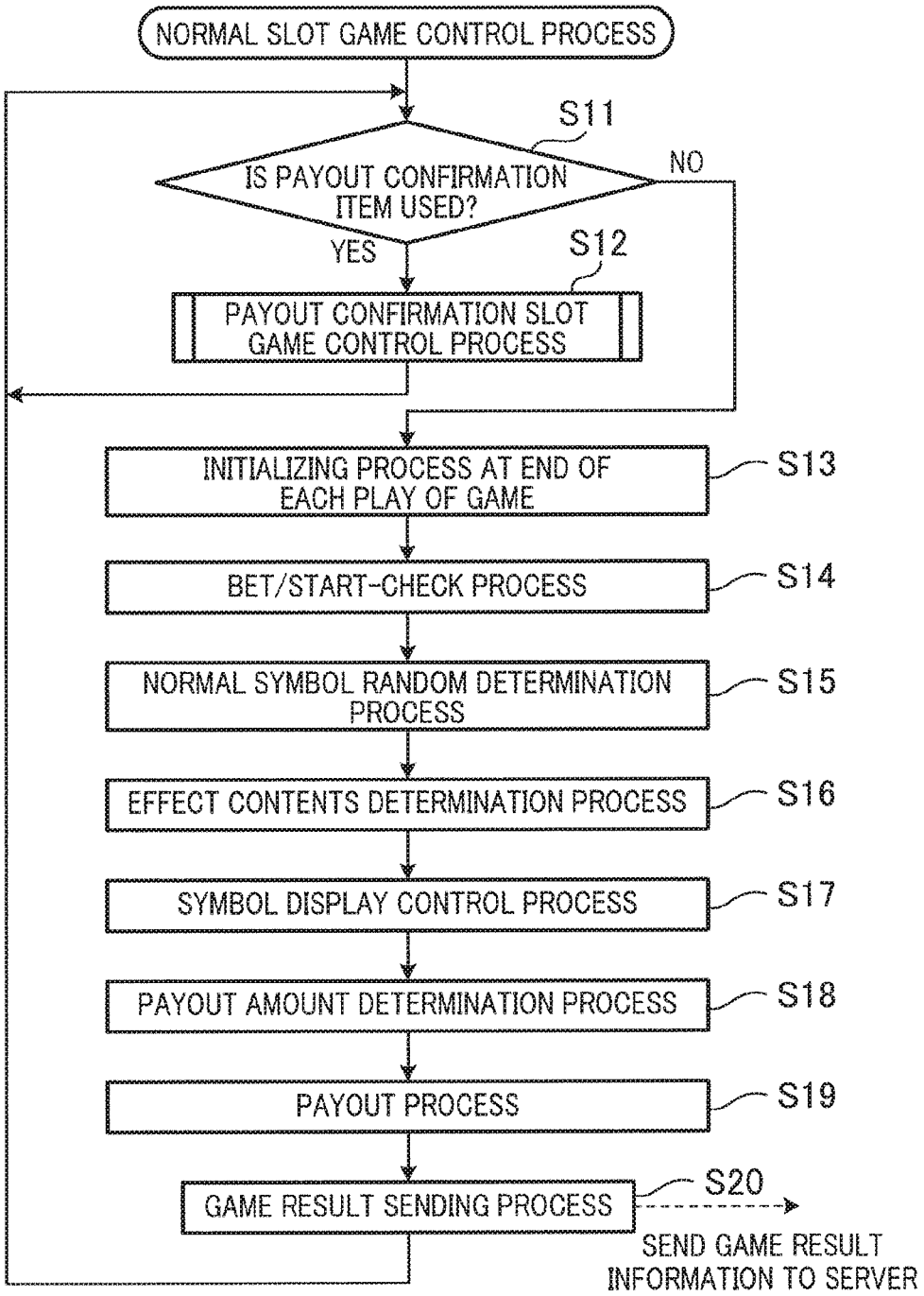
FIG. 9 shows a flowchart of a normal slot game control process.

The program of the slot game executed between the smartphone 1 and the server 100 will be described with reference to FIG. 9 to FIG. 11.

(Normal Slot Game Control Process)

The normal slot game control process executed by the smartphone 1 will be described with reference to FIG. 9.

To begin with, before the start of the slot game, the CPU 101 checks if a "GIGA WIN conformation (in 100 games, in 200 games, in 300 games)" item or a "GOD WIN confirmation (in 100 games, in 200 games, in 300 games)" item has been used (i.e., checks if a payout confirmation item has been used) (S11). When the "GIGA WIN conformation (in 100 games, in 200 games, in 300 games)" item or the "GOD WIN confirmation (in 100 games, in 200 games, in 300 games)" item has been used (YES in S11), the routine shifts to a payout confirmation slot game control process (S12). The payout confirmation slot game control process (S12) will be detailed later. After S12, the routine goes back to S11. The use of the "GIGA WIN conformation (in 100 games, in 200 games, in 300 games)" item or the "GOD WIN confirmation (in 100 games, in 200 games, in 300 games)" item is equivalent to "a process of accepting an input for increasing the probability of establishment of an arrangement pattern corresponding to a specific payout" in the present invention.

How items such as the "GIGA WIN conformation (in 100 games, in 200 games, in 300 games)" item and the "GOD WIN confirmation (in 100 games, in 200 games, in 300 games)" item are obtained in the slot game of the present embodiment will be described. In the slot game of the present embodiment, various items can be obtained in the advancement of the slot game, as a benefit awarded as a result of the slot game, or in exchange for coins in a shop. For example, after the end of the unit game in the slot game, the player is allowed to touch an image of a shop button 246 in the operation display area 24 shown in FIG. 3 to display a shop window in which exchange to various items can be done. In the shop window, icons each associated with the number of coins required to exchange for an item are displayed. The player is allowed to select any of the displayed icons to exchange the owned coins for a desired item.

Figure 12:
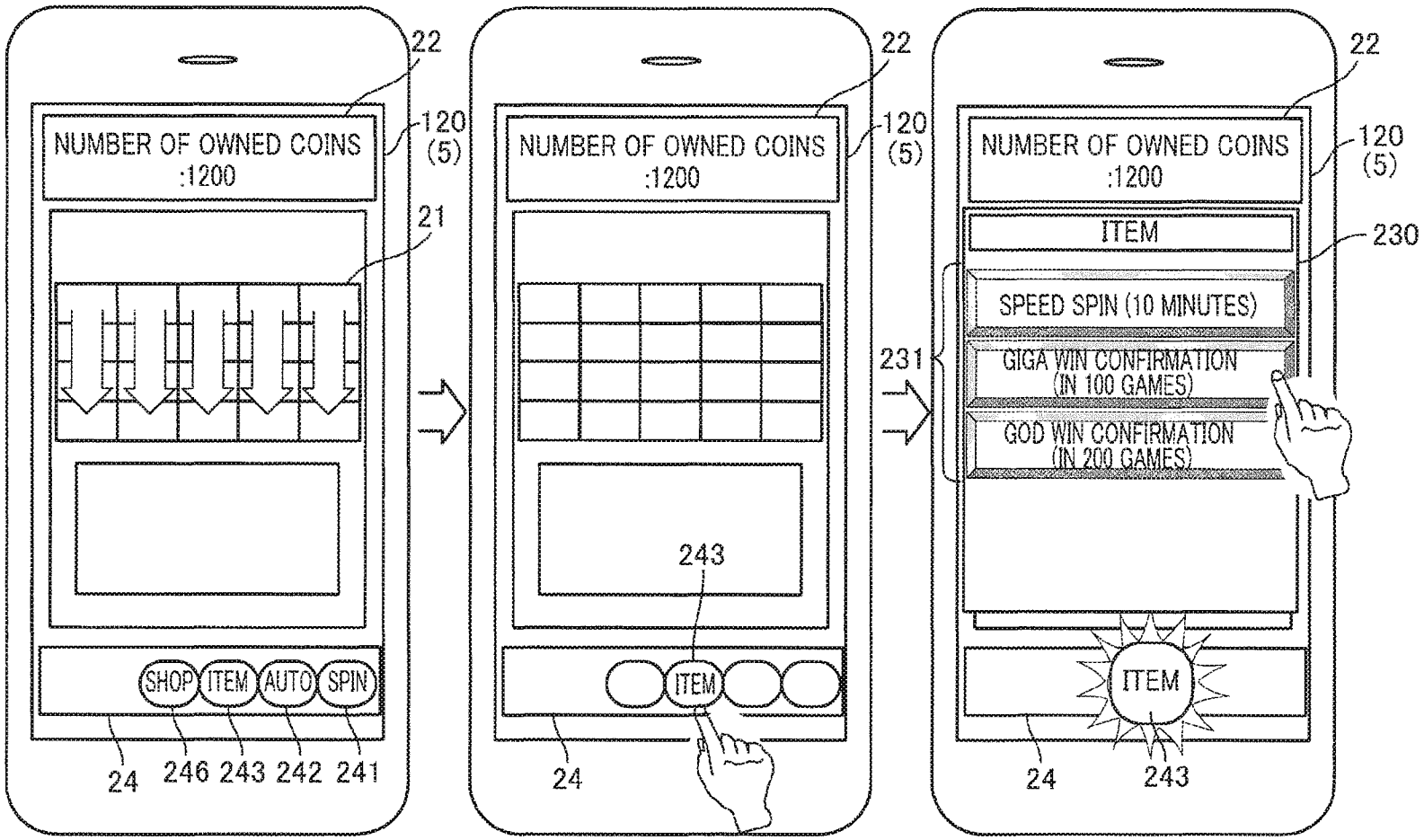
FIG. 12 illustrates a display screen of the slot game displayed on a smartphone.

The following will briefly describe how items obtained in the progress of the slot game, etc., are used. In the present embodiment, for example, as shown in FIG. 12, after the end of the unit game in the slot game, etc., the player is allowed to touch an image of an ITEM button 243 in the operation display area 24 to display an item window 230 in which items owned by the player are displayed for selection. In the item window 230, as shown in FIG. 12, item icons 231 owned by the player are displayed. The player is allowed to select any of the displayed item icons 231 to be used. For example, as shown in FIG. 12, when the item icon 231 corresponding to "GIGA WIN confirmation (in 100 games)" is selected from three item icons 231, an effect of the use of the item "GIGA WIN confirmation (in 100 games)" is exerted.

In the present embodiment, when the "GIGA WIN confirmation (in 100 games)" item is used, the routine shifts to a payout confirmation slot game control process (S12). Thereafter, during the period in which the unit game is executed 100 times, an effect of awarding a payout which is 60 to 99 times as much as the amount of betted coins at least once is exerted. When the "GIGA WIN confirmation (in 200 games)" item is used, during the period in which the unit game is executed 200 times, an effect of awarding a payout which is 60 to 99 times as much as the amount of betted coins at least twice is exerted. When the "GIGA WIN confirmation (in 300 games)" item is used, during the period in which the unit game is executed 300 times, an effect of awarding a payout which is 60 to 99 times as much as the amount of betted coins at least three times is exerted.

When the "GOD WIN confirmation (in 100 games)" item is used, the routine shifts to the payout confirmation slot game control process (S12). Thereafter, during the period in which the unit game is executed 100 times, an effect of awarding a payout which is 100 or more times as much as the amount of betted coins at least once is exerted. When the "GOD WIN confirmation (in 200 games)" item is used, during the period in which the unit game is executed 200 times, an effect of awarding a payout which is 100 or more times as much as the amount of betted coins at least twice is exerted. When the "GOD WIN confirmation (in 300 games)" item is used, during the period in which the unit game is executed 300 times, an effect of awarding a payout which is 100 or more times as much as the amount of betted coins at least three times is exerted.

In the case of, for example, the "GIGA WIN confirmation (in 100 games)" item, an effect of awarding a payout which is 60 to 99 times as much as an amount of betted coins at least once is executed in the period in which the unit game is executed 100 times. In this regard, the period in which the unit game is executed and the number of times of awarding of a payout can be set at will, and the range of the multiplying factor on a payout can be set at will. (The same applies to the GOD WIN confirmation item.) The way of acquisition, the way of use, and the effects of the payout confirmation items such as the GIGA WIN confirmation item and the GOD WIN confirmation item have been described.

In S11, when none of the "GIGA WIN conformation (in 100 games, in 200 games, in 300 games)" item and the "GOD WIN confirmation (in 100 games, in 200 games, in 300 games)" item is used (NO in S11), the CPU 101 executes an initializing process at the end of each play of the game, in order to start the slot game (S13). For example, this process clears data in a working area of the RAM 103, which becomes unnecessary at the end of each play of the unit game, e.g., a payline activated in the previous execution of the unit game, the value of a bet counter in a bet amount storage area, and symbols to be displayed on the symbol display area 21 as a result of random determination.

The CPU 101 then executes a bet/start-check process (S14). In this bet/start check process, which payline is activated is determined (see FIG. 4). (In the present embodiment, all paylines are activated.) By a touch input such as pressing of a "+" button and a "−" button (see FIG. 3) of the bet button 244 of the operation display area 24 of the display 120 of the smartphone 1, the number of coins betted on the payline activated by the player is determined. The number of coins betted on the activated payline is stored in a bet amount counter of the RAM 103. The number of coins betted and the activated payline are determined in this way. As a result, when a win is achieved in the slot game, a payout awarded for the win equals to a value calculated by multiplying a payout corresponding to the win achieved on the activated payline (symbol arrangement pattern) (see FIG. 8) by the number of betted coins. In the bet/start-check process, furthermore, the CPU 101 determines whether a touch input has been made to the spin button 241. When a touch input has been made to the spin button 241, the routine proceeds to S15 and the slot game progresses.

Then, the CPU 101 executes a normal symbol random determination process (S15). In this process, by using the video reels shown in FIG. 5, to-be-stopped symbols are randomly selected from symbols provided on the video reels (REEL1, REEL2, REEL5, REEL4, and REEL5). The to-be-stopped symbols are data of five symbols to be displayed in the lower middle stage of each column of the symbol display area 21, out of the symbols forming each video reel. In this way, 20 symbols displayed in the symbol display area 21 are determined.

For example, in case of REEL1 of the video reels, when a code number "22" is randomly selected from 26 symbols (code numbers "0" to "25"), the "JACK" symbol corresponding to the code number "22" is selected as the to-be-stopped symbol. In case of the REEL2, when a code number "11" is randomly selected from 29 symbols (code numbers "0" to "28"), the "CHERRY" symbol corresponding to the code number "11" is selected as the to-be-stopped symbol. In case of the REEL3, when a code number "9" is randomly selected from 28 symbols (code numbers "0" to "27"), the "10" symbol corresponding to the code number "9" is selected as the to-be-stopped symbol. In case of the REEL4, when a code number "8" is randomly selected from 27 symbols (code numbers "0" to "26"), the "10" symbol corresponding to the code number "8" is selected as the to-be-stopped symbol. In case of the REEL5, when a code number "7" is randomly selected from 34 symbols (code numbers "0" to "33"), the "HEART" symbol corresponding to the code number "7" is selected as the to-be-stopped symbol.

The CPU 101 then stores the determined five to-be-stopped symbols in a symbol storing area in the RAM 103.

Subsequently, the CPU 101 executes an effect contents determination process (S16). The CPU 101 samples an effect-use random number and randomly selects any of a plurality of predetermined effect contents.

Figure 13:
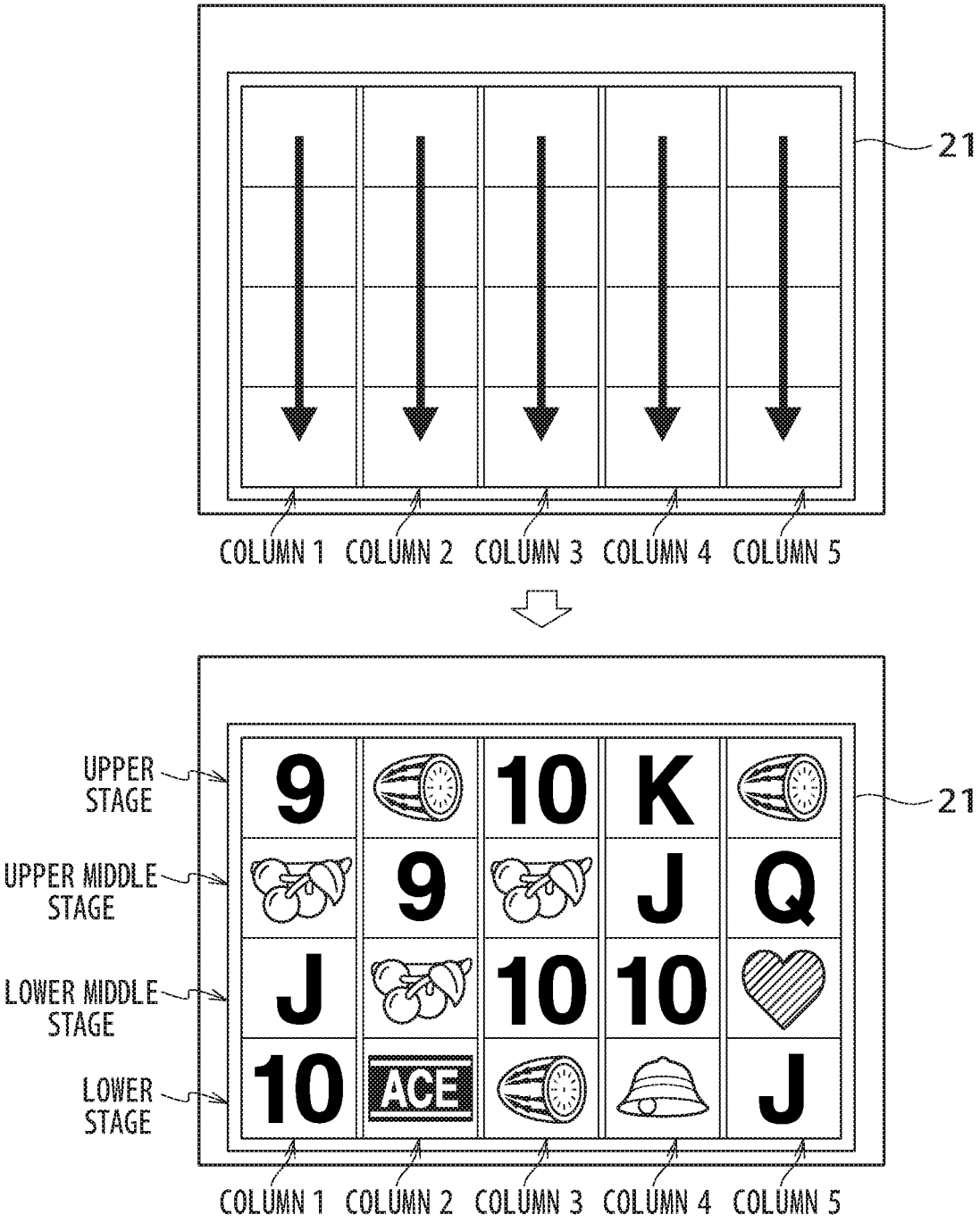
FIG. 13 illustrates a display screen of the slot game (normal symbol random determination) displayed on a smartphone.

Then, the CPU 101 executes a symbol display control process (S17). In this symbol display control process, as shown in FIG. 13, the scroll of the symbol arrays (REEL1, REEL2, REEL3, REEL4, and REEL5) of the video reels starts. After a predetermined time elapses, the five to-be-stopped symbols selected in the symbol random determination process in S15 are rearranged one by one in the lower middle stages of the column 1 to the column 5 of the symbol display area 21. In other words, 20 symbols including the to-be-stopped symbols are rearranged in the symbol display area 21. For example, as described above, when the "JACK" symbol is selected as a to-be-stopped symbol in the REEL1, the "CHERRY" symbol is selected as a to-be-stopped symbol in the REEL2, the "10" symbol is selected as a to-be-stopped symbol in the REEL3, the "10" symbol is selected as a to-be-stopped symbol in the REEL4, and the "HEART" symbol is selected as a to-be-stopped symbol in the REEL5, the symbols "JACK", "CHERRY", "10", "10", and "HEART" are provided in the lower middle stages of the column 1 to the column 5 of the symbol display area 21. In the upper, upper middle, and lower stages of each of the column 1 to the column 5 of the symbol display area 21, symbols having code numbers each of which is one number off the to-be-stopped symbols are rearranged (see FIG. 13).

Subsequently, the CPU 101 executes a payout amount determination process (S18). In this process, whether three or more symbols of the same type are successively rearranged on the activated payline and a win is achieved is determined based on the symbol combination table for the slot game (see FIG. 8), which is stored in the RAM 103. In accordance with the type of win, a benefit will be given in the form of awarding a payout and the like. The payout awarded is stored in a payout amount storage area which is provided in the RAM 103.

For example, when the "7" symbol is rearranged at row 1, column 1, the "7" symbol is rearranged at row 1, column 2, the "7" symbol is rearranged at row 1, column 3, and the "CHERRY" symbol is rearranged at row 1, column 4 on a payline 1 (see FIG. 4), a win with 3Kinds of "7" is achieved. For the 3Kinds of "7", the symbol combination table shown in FIG. 8 is referred to, and a payout is determined as "50" coins (when the amount of betted coins is 1) and this payout amount is stored in the payout amount storage area in the RAM 103.

In the payout amount determination process, whether a win with "BONUS" (3Kinds of "BONUS", 4Kinds of "BONUS", or 5Kinds of "BONUS") is established is further determined. When the "BONUS" win is achieved, the free game is executed. This free game allows the player to play the slot game the number of times corresponding to the established "BONUS" win, without the consumption of coins. For example, in the case of the 3Kinds of "BONUS", the free game can be played five times (see FIG. 8).

Subsequently, the CPU 101 executes a payout process (S19). The CPU 101 adds a value stored in the payout amount storage area of the RAM 103 to the value of the coin counter provided in the RAM 103. For example, when "50" is stored in the payout amount storage area in the payout amount determination process in S18, "50" is added to the value of the coin counter.

The CPU 101 then executes a game result sending process (S20). In this game result sending process, results of the execution of the slot game once (unit game) are sent to the server 100 as game result information. The results are, for example, the number of coins betted in S14 (the value of the bet counter in the RAM 103), the to-be-stopped symbols determined in the normal symbol random determination process in S15 (i.e., 20 symbols displayed in the symbol display area 21), the type of a win achieved in the payout amount determination process in S18 (including a failure), and the value of the coin counter updated in the payout process (i.e., the number of coins owned). After S20, the routine goes back to S11.

(Payout Confirmation Slot Game Control Process)

Figure 10:
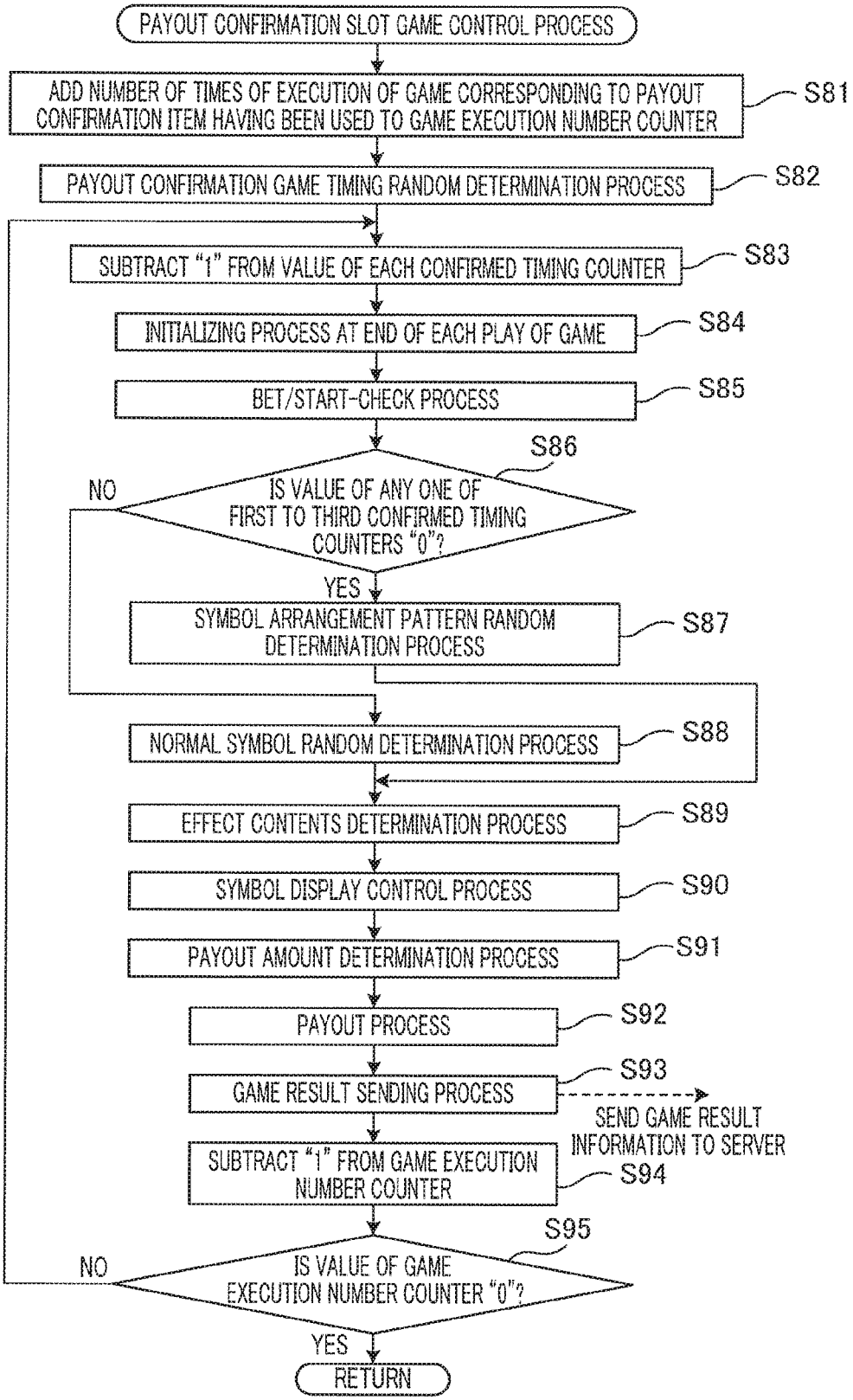
FIG. 10 is a flowchart of a payout confirmation slot game control process.

The following describes a payout confirmation slot game control process with reference to FIG. 10. This payout confirmation slot game control process is executed when, in S11 of the normal slot game control process, it is determined that the "GIGA WIN conformation (in 100 games, in 200 games, in 300 games)" item or the "GOD WIN confirmation (in 100 games, in 200 games, in 300 games)" item has been used (YES in S11).

To begin with, the CPU 101 adds the number of times of execution (time) of the game corresponding to the payout confirmation item having been used to a game execution number counter of the RAM 103 (S81). For example, when the "GIGA WIN confirmation (in 100 games)" item has been used, "100" is added to the game execution number counter of the RAM 103. When the "GIGA WIN confirmation (in 200 games)" item has been used, "200" is added to the game execution number counter of the RAM 103. When the "GIGA WIN confirmation (in 300 games)" item has been used, "300" is added to the game execution number counter of the RAM 103. The same applies to the GOD WIN confirmation items.

Figure 14:
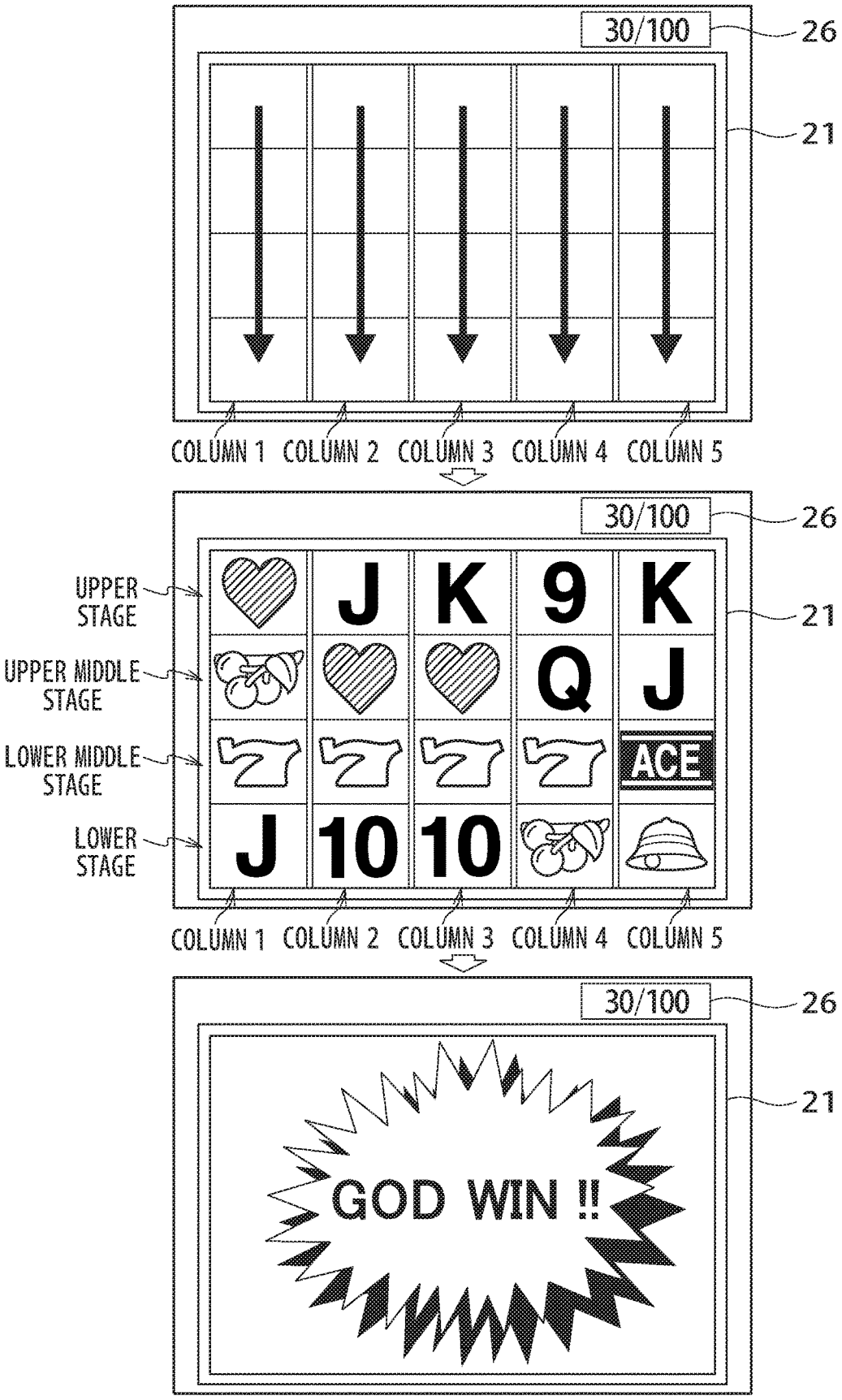
FIG. 14 illustrates a display screen of the slot game (symbol arrangement pattern random determination) displayed on the smartphone.

When a payout confirmation item has been used, the current value of the game execution number counter is reflected to and displayed in an execution game number display area 26 shown in FIG. 14. For example, when the "GIGA WIN confirmation (in 100 games)" item is used and then the unit game is executed 30 times in the payout confirmation slot game control process, the value "30/100" is displayed in the execution game number display area 26 shown in FIG. 14.

Subsequently, the CPU 101 executes a payout confirmation game timing random determination process (S82). In this payout confirmation game timing random determination process, in which number of times of execution of the game (i.e., at which timing) a payout corresponding to a payout confirmation item having been used is awarded is randomly determined. The randomly determined timing is stored in each of a first confirmed timing counter to a third confirmed timing counter of the RAM 103 (S82). For example, when the payout confirmation item having been used is the "GIGA WIN confirmation (in 100 games)" item, one of values 1 to 100 is randomly selected. When the selected value is "40", "40" is stored in the first confirmed timing counter of the RAM 103. (The second confirmed timing counter and the third confirmed timing counter are not used in this case.) When the payout confirmation item having been used is the "GIGA WIN confirmation (in 200 games)" item, two of values 1 to 200 are randomly selected. When the selected values are "30" and "140", "30" is stored in the first confirmed timing counter of the RAM 103 and "140" is stored in the second confirmed timing counter. (The third confirmed timing counter is not used in this case.) When the payout confirmation item having been used is the "GIGA WIN confirmation (in 300 games)" item, three of values 1 to 300 are randomly selected. When the selected values are "30", "40", and "290", "30" is stored in the first confirmed timing counter of the RAM 103, "40" is stored in the second confirmed timing counter, and "290" is stored in the third confirmed timing counter.

Subsequently, the CPU 101 subtracts "1" from each of the values of the first confirmed timing counter to the third confirmed timing counter of the RAM 103 (S83). The value of each of the first confirmed timing counter to the third confirmed timing counter may be a negative value. For example, when the value of the first confirmed timing counter is "0", the value of the first confirmed timing counter is updated to "−1" after the subtraction of "1".

Subsequently, in the same manner as in S13, the CPU 101 executes an initializing process at the end of each play of the game, in order to start the slot game (S84).

The CPU 101 then executes a bet/start-check process in the same manner as in S14 (S85).

Subsequently, the CPU 101 determines whether at least one of the values of the first confirmed timing counter, the second confirmed timing counter, and the third confirmed timing counter of the RAM 103 is "0" (S86). When at least one of the values of the first confirmed timing counter, the second confirmed timing counter, and the third confirmed timing counter is "0" (YES in S86), the CPU 101 executes a symbol arrangement pattern random determination process (S87). In this symbol arrangement pattern random determination process, when the payout confirmation item which is currently used is a GIGA WIN confirmation item, a symbol combination to be displayed in the symbol display area 21 is randomly determined with reference to the GIGA WIN confirmation symbol combination table shown in FIG. 6. The "symbol combination (20 symbols) to be displayed in the symbol display area 21" having been determined in S87 are stored, as to-be-stopped symbols, in a symbol storing area of the RAM 103.

In the present embodiment, three counters, i.e., the first confirmed timing counter, the second confirmed timing counter, and third confirmed timing counter are used. On this account, when the "GIGA WIN confirmation (in 100 games)" item is used, the symbol arrangement pattern random determination process (using the GIGA WIN confirmation symbol combination table) in S87 is executed once during the period in which the unit game is executed 100 times. When the "GIGA WIN confirmation (in 200 games)" item is used, the symbol arrangement pattern random determination process (using the GIGA WIN confirmation symbol combination table) in S87 is executed twice during the period in which the unit game is executed 200 times. When the "GIGA WIN confirmation (in 300 games)" item is used, the symbol arrangement pattern random determination process (using the GIGA WIN confirmation symbol combination table) in S87 is executed three times during the period in which the unit game is executed 300 times.

In the symbol arrangement pattern random determination process, when the payout confirmation item which is currently used is a GOD WIN confirmation item, a symbol combination of 20 symbols to be displayed in the symbol display area 21 is randomly determined with reference to the GOD WIN confirmation symbol combination table shown in FIG. 7. The "symbol combination (20 symbols) to be displayed in the symbol display area 21" having been determined in S87 are stored, as to-be-stopped symbols, in a symbol storing area of the RAM 103.

In the present embodiment, three counters, i.e., the first confirmed timing counter, the second confirmed timing counter, and third confirmed timing counter are used. On this account, when the "GOD WIN confirmation (in 100 games)" item is used, the symbol arrangement pattern random determination process (using the GOD WIN confirmation symbol combination table) in S87 is executed once during the period in which the unit game is executed 100 times. When the "GOD WIN confirmation (in 200 games)" item is used, the symbol arrangement pattern random determination process (using the GOD WIN confirmation symbol combination table) in S87 is executed twice during the period in which the unit game is executed 200 times. When the "GOD WIN confirmation (in 300 games)" item is used, the symbol arrangement pattern random determination process (using the GOD WIN confirmation symbol combination table) in S87 is executed three times during the period in which the unit game is executed 300 times.

When none of the values of the first confirmed timing counter, the second confirmed timing counter, and the third confirmed timing counter is "0" (NO in S86), the CPU 101 executes the normal symbol random determination process in the same manner as in S15 (S88). In this step, by using the video reels shown in FIG. 5, five symbols to be displayed in the lower middle stages of the respective columns of the symbol display area 21 are randomly determined as to-be-stopped symbols. The CPU 101 then stores the five to-be-stopped symbols determined in S88 in the symbol storing area of the RAM 103.

In this way, when (i) at least one of the values of the first confirmed timing counter, the second confirmed timing counter, and the third confirmed timing counter is "0" (YES in S86), (ii) the effect of the payout confirmation item is exerted, and (iii) the symbol arrangement pattern random determination process (S87) is executed, the normal symbol random determination process which is executed in, for example, the normal slot game control process is not executed and the symbol arrangement pattern random determination process is executed to randomly determine the symbol combination displayed in the symbol display area 21.

Subsequently, the CPU 101 executes an effect contents determination process as in S16 (S89). The CPU 101 samples an effect-use random number and randomly selects any of a plurality of predetermined effect contents.

The CPU 101 then executes a symbol display control process based on the to-be-stopped symbols stored in the symbol storing area (S90). In this symbol display control process, when the to-be-stopped symbols are determined in the normal symbol random determination process in S88, as shown in FIG. 13, the scroll of the symbol arrays (REEL1, REEL2, REEL3, REEL4, and REEL5) of the video reels starts. After a predetermined time elapses, the to-be-stopped symbols selected in the symbol random determination process in S88 (five to-be-stopped symbols) are rearranged one by one in the lower middle stages of the column 1 to the column 5 of the symbol display area 21. In other words, 20 symbols including the to-be-stopped symbols are rearranged in the symbol display area 21.

Meanwhile, when the to-be-stopped symbols are determined in the symbol arrangement pattern random determination process in S87, as shown in FIG. 14, the scroll of the symbol arrays (REEL1, REEL2, REEL3, REEL4, and REEL5) of the video reels starts so that the "symbol combination" determined in S87 is displayed in the symbol display area 21. After a predetermined time elapses, the to-be-stopped symbols selected in S87 (20 symbols) are rearranged one by one in the symbol display area 21. At this stage, when a symbol combination with which a payout 60 to 99 times as much as an amount of betted coins is displayed in the symbol display area 21, a message "GIGA WIN!!" is displayed on the display 120. When a symbol combination with which a payout 100 or more times as much as an amount of betted coins is displayed in the symbol display area 21, a message "GOD WIN!!" is displayed on the display 120 (see FIG. 14).

Subsequently, the CPU 101 executes a payout amount determination process (S91). In this process, whether a win is achieved is determined based on the symbol combination table for the slot game (see FIG. 8), which is stored in the RAM 103. In accordance with the type of win, a payout is awarded. The payout awarded is stored in a payout amount storage area which is provided in the RAM 103.

Subsequently, the CPU 101 executes a payout process (S92). The CPU 101 adds a value stored in the payout amount storage area of the RAM 103 to the value of the coin counter provided in the RAM 103.

The CPU 101 then executes a game result sending process (S93). In this game result sending process, a result of execution of the slot game (unit game) once is sent to the server 100 as game result information, in the same manner as in S20.

Subsequently, the CPU 101 subtracts "1" from the value of the game execution number counter of the RAM 103 (S94).

Subsequently, the CPU 101 determines whether the value of the game execution number counter of the RAM 103 is "0" (S95). When the value of the game execution number counter is not "0" (NO in S95), the routine goes back to S83.

Meanwhile, when the value of the game execution number counter is "0" in S95 (YES in S95), the process is terminated.

In the present embodiment, when, for example, the "GIGA WIN confirmation (in 100 games)" item is used, the symbol arrangement pattern random determination process (using the GIGA WIN confirmation symbol combination table) in S87 is always executed once during the period in which the unit game is executed 100 times and a payout which is 60 to 99 times as much as an amount of betted coins is always awarded once. This, however, does not mean that the number of times of awarding a payout which is 60 to 99 times as much as an amount of betted coins during the period in which the unit game is executed 100 times is limited to once, and a payout (which is 60 to 99 times as much as an amount of betted coins) awarded as a result of the normal symbol random determination in S88 is not excluded. In other words, even when the "GIGA WIN confirmation (in 100 games)" item has been used, a payout which is 60 to 99 times as much as an amount of betted coins may be awarded twice or more during the period in which the unit game is executed 100 times, if a payout which is 60 to 99 times as much as an amount of betted coins is awarded as a result of the normal symbol random determination in S88. On this account, when a payout (GIGA WIN) which is 60 to 99 times as much as an amount of betted coins is awarded in a state in which the current value of the game execution number counter is displayed in the execution game number display area 26 (see FIG. 14) and the "GIGA WIN confirmation (in 100 games)" item has currently been used, it is unknown for the player whether the payout is awarded because the effect of the "GIGA WIN confirmation (in 100 games)" item is exerted and the payout is resulted from the symbol arrangement pattern random determination process in S87 or the payout is awarded as a result of the normal symbol random determination process in S88 irrespective of the effect of the "GIGA WIN confirmation (in 100 games)" item.

As described above, in the process of repeatedly executing the slot game, when it is aimed to increase only the probability of establishment of a symbol combination (arrangement pattern) corresponding to "GIGA WIN" with which a payout 60 to 99 times as much as an amount of betted coins is awarded or "GOD WIN" with which a payout 100 or more times as much as an amount of betted coins is awarded, during the period in which the probabilities of establishment of "GIGA WIN" or "GOD WIN" are desired to be increased (e.g., in 100 games, 200 games, or 300 games), at which timing the symbol combination corresponding to "GIGA WIN" or "GOD WIN" is rearranged is randomly determined in S82. At the determined timing after the repeated execution of the slot game, the symbol combination corresponding to "GIGA WIN" or "GOD WIN" is displayed in the symbol display area 21. With this arrangement, even though there are many symbol combinations including lost, it is possible to easily increase the winning probability of a "GIGA WIN" payout or a "GOD WIN" payout during a predetermined period (in 100 games, 200 games, or 300 games), as the player uses a payout confirmation item.

In the symbol arrangement pattern random determination process in S87, when the payout confirmation item which is currently used is a GIGA WIN confirmation item, a symbol combination to be displayed in the symbol display area 21 is randomly determined with reference to the GIGA WIN confirmation symbol combination table shown in FIG. 6.

When the payout confirmation item which is currently used is a GOD WIN confirmation item, a symbol combination of 20 symbols to be displayed in the symbol display area 21 is randomly determined with reference to the GOD WIN confirmation symbol combination table shown in FIG. 7. Because one symbol combination is randomly selected from plural symbol combinations, it is possible to provide plural types of (100 types in the present embodiment as shown in FIG. 6 and FIG. 7) payouts corresponding to "GIGA WIN" and "GOD WIN". With this arrangement, it is possible to easily increase the winning probability of a "GIGA WIN" payout or a "GOD WIN" payout during a predetermined period (in 100 games, 200 games, or 300 games). The plural types of "GIGA WIN" and the plural types of "GOD WIN" are associated with payouts each of which is predetermined times as much as a received bet amount ("GIGA WIN" is associated with a payout which is 60 to 99 times as much as an amount of betted coins and "GOD WIN" is associated with a payout which is 100 or more times as much as an amount of betted coins). This makes it possible to easily increase the winning probability of a "GIGA WIN" payout or a "GOD WIN" payout.

(Server Backup Process)

Figure 11:
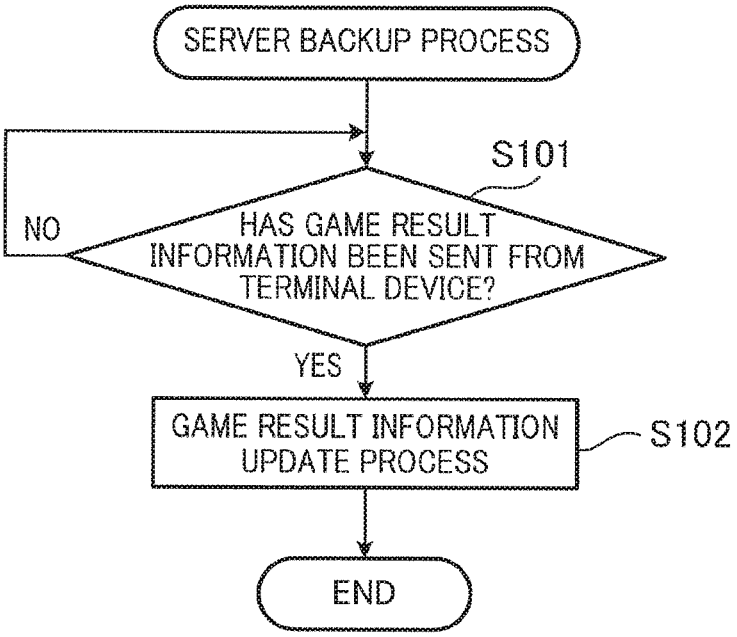
FIG. 11 shows a flowchart of a server backup process.

The following will describe a server backup process with reference to FIG. 11.

The control unit 131 of the server 100 determines whether game result information has been received from the smartphone 1 (terminal device) (S101). When the game result information has not been received (NO in S101), the sending of the information is waited for.

Meanwhile, when the game result information has been received (YES in S101), the control unit 131 executes a game result information update process (S102). In this game result information update process, the user is specified based on the identification number of the smartphone 1 which has sent the game result information, and the game result information of each user is stored in the storage unit 132. This makes it possible to store results of each execution of a slot game on each smartphone 1, such as the number of betted coins, selected to-be-stopped symbols, and an awarded payout, in the storage unit 132 as the game result information of each user. Then, this process is terminated.

Other Embodiments

In the embodiment above, in the payout confirmation slot game control process, in which number of times of execution of the game (i.e., at which timing) a payout corresponding to a payout confirmation item having been used is awarded is randomly determined in S82. This random determination, however, may not be included in the process. In such a case, when a payout confirmation item is used, an effect of the payout confirmation item is immediately exerted in the next execution of the unit game. For example, when the "GIGA WIN confirmation" item is used, an effect of awarding a payout which is 60 to 99 times as much as the amount of betted coins is exerted at the next execution of the unit game. To be more specific, in the payout confirmation slot game control process shown in FIG. 10, the steps S81, S82, S83, S86, S88, S94, and S95 are omitted from the flow chart.

When a payout confirmation item is used, an effect of the payout confirmation item may be exerted in a predetermined number of times of execution of the game (i.e., at a predetermined timing). (The timing is set by the administrator of the slot game and is not notified to the players.) For example, when the "GIGA WIN confirmation" item is used, an effect of awarding a payout which is 60 to 99 times as much as the amount of betted coins at least three time is always exerted in the predetermined number of times of execution of the unit game (i.e., at the predetermined timing).

The slot game in the embodiment above may be, as game software (a program and game data), installed in and executed by an information processor. Examples of the information processor include mobile information devices such as a smartphone, a portable computer, a laptop computer, a note PC, a tablet PC, a handheld PC, and a PDA (Personal Data Assistant). The game software by which the slot game is executed is downloaded from a server or the like via communication means and stored in a storage device (e.g., a flash memory) in the mobile information device. The communication means may be an interactive communication passage such as the Internet and a cable TV, or may be one-way broadcasting.

The game software by which the slot game is executed may be stored in a recording medium such as a CD-ROM, a DVD-ROM, an MO (optical magnetic disc), a hard disk, and a flash memory, and may be read from the recording medium and installed in a storage device of a information processor such as the server 100 and the smartphone 1, according to need.

The disclosure of the embodiment above may be embodied as a game program which is executed between each smartphone 1 and the server 100 over the Internet (communication line). In this case, the game program may be stored in a recording medium such as a CD-ROM, a DVD-ROM, an MO (optical magnetic disc), a hard disk, and a flash memory, and may be read from the recording medium according to need.

The processes executed in the embodiment above may be a game program installed in the smartphone 1 (terminal device). The game program may be stored in a recording medium (medium).

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

What is claimed is:

1. An information processor configured to execute a unit game based on rearrangement of symbols by consuming gaming media, with the unit game being selectively executed in one of a normal mode and a payout confirmation mode that guarantees at least one occurrence of an advantageous game result, the information processor comprising:

a purchase mechanism by which the user obtains the gaming media used to execute the unit game in exchange for financial resources;

a computer processor;

a terminal device through which a user executes the unit game, the terminal device including a display with a symbol display area that includes a plurality of symbol rearrangement areas; and computer memory having stored therein symbol display data used to display the plurality of symbols in the plurality of rearrangement areas, symbol combination data used to display the plurality of symbols in one of a plurality of available predefined symbol rearrangement patterns that determine the collective arrangement of the symbols in all rearrangement areas, with the predefined symbol rearrangement patterns each having associated therewith an advantageous game result, and computer instructions executable by the computer processor for implementing the unit game;

wherein the computer instructions, when executed by the computer processor, cause execution of steps of determining whether an input has been made to the terminal device to execute the unit game in the payout confirmation mode, if the input to execute the unit game in the payout confirmation mode has not been made, executing the unit game in the normal mode, with a symbol to be displayed in each of the rearrangement areas being randomly determined, on a rearrangement-area-by-rearrangement-area basis, using the symbol display data to yield a normal-game result based on the totality of randomly selected symbols appearing in all of the rearrangement areas; and if the input to execute the unit game in the payout confirmation mode has been made, executing the unit game in the payout confirmation mode a predefined number of times, wherein, for at least one instance of executing the unit game in the payout confirmation mode the predefined number of times, a predefined symbol rearrangement pattern is selected from among the plurality of available predefined symbol rearrangement patterns to yield the advantageous game result associated with the selected predefined symbol rearrangement pattern.

2. The information processor according to claim 1, wherein if the input to execute the unit game in the payout confirmation mode has been made, at least one timing determination number is randomly determined prior to executing the unit game in the payout confirmation mode, the timing determination number identifying a sequential number of executions of the unit game at which the predefined symbol rearrangement pattern is selected from among the plurality of available predefined symbol rearrangement patterns to yield the advantageous game result.

3. The information processor according to claim 1, wherein if the input to execute the unit game in the payout confirmation mode has been made, for instances of executing the unit game the predefined number of times other than said at least one instance of executing the unit game in the payout confirmation mode, symbols to be displayed in each of the rearrangement areas are determined in the same manner as symbols to be displayed in each of the rearrangement areas are determined when executing the unit game in the normal mode.

4. The information processor according to claim 1, wherein a plurality of different inputs are available to be made to the terminal device to execute the unit game in the payout confirmation mode, and the number of times an advantageous game result is guaranteed to occur during execution of the unit game in the payout confirmation mode depends on which of the different inputs has been made.

5. The information processor according to claim 1, wherein a plurality of different inputs are available to be made to the terminal device to execute the unit game in the payout confirmation mode, and the predefined number of times the unit game will be executed in the payout confirmation mode depends on which of the different inputs has been made.

6. The information processor according to claim 1, wherein a plurality of different inputs are available to be made to the terminal device to execute the unit game in the payout confirmation mode, the number of times an advantageous game result is guaranteed to occur during execution of the unit game in the payout confirmation mode depends on which of the different inputs has been made, and the predefined number of times the unit game will be executed in the payout confirmation mode depends on which of the different inputs has been made.

7. The information processor according to claim 1, wherein a plurality of different inputs are available to be made to the terminal device to execute the unit game in the payout confirmation mode, and a degree of potential advantageousness of the advantageous game result depends on which of the different inputs has been made.

8. A non-volatile recording medium storing a game program to be executed by an information processor that includes 1) a computer processor and 2) a terminal device including a display with a symbol display area that includes a plurality of symbol rearrangement areas, the information processor being configured to execute a unit game based on rearrangement of symbols with the unit game being selectively executed in one of a normal mode and a payout confirmation mode that guarantees at least one occurrence of an advantageous game result, the game program causing the computer processor to execute steps of:

determining whether an input has been made to the terminal device to execute the unit game in the payout confirmation mode, if the input to execute the unit game in the payout confirmation mode has not been made, executing the unit game in the normal mode, with a symbol to be displayed in each of the rearrangement areas being randomly determined, on a rearrangement-area-by-rearrangement-area basis, using symbol display data to yield a normal-game result based on the totality of randomly selected symbols appearing in all of the rearrangement areas; and if the input to execute the unit game in the payout confirmation mode has been made, executing the unit game in the payout confirmation mode a predefined number of times, wherein, for at least one instance of executing the unit game in the payout confirmation mode the predefined number of times, a predefined symbol rearrangement pattern is selected from among a plurality of available predefined symbol rearrangement patterns, with each of the plurality of available predefined symbol rearrangement patterns determining a collective arrangement of the symbols in all rearrangement areas and with each of the available predefined symbol rearrangement patterns having associated therewith an advantageous game result.

* * * * *